United States Patent [19]

Moessinger et al.

[11] Patent Number: 4,553,570

[45] Date of Patent: Nov. 19, 1985

[54] PROCESS FOR THE INSERTION IN THE FORM OF A LOOP OF A WEFT YARN IN THE SHED OF A WEAVING MACHINE AND WEAVING MACHINE EQUIPPED WITH A DEVICE FOR CARRYING OUT THIS PROCESS

[75] Inventors: Albert Moessinger, Vaud, Switzerland; Guy Gosciniak, Illfurth; Joël Angebault, Riedisheim, both of France

[73] Assignee: Societe Alsacienne de Construction de Material Textile, Mulhause, France

[21] Appl. No.: 527,848

[22] Filed: Aug. 30, 1983

[30] Foreign Application Priority Data

Sep. 3, 1983 [FR] France ..... 82 15144

[51] Int. Cl.[4] ..... D03D 47/30

[52] U.S. Cl. ..... 139/435; 139/443

[58] Field of Search ..... 139/429, 435, 443

[56] References Cited

U.S. PATENT DOCUMENTS

| | | | |
|---|---|---|---|
| 2,982,315 | 5/1961 | Wille | 139/435 |
| 3,139,118 | 6/1964 | Svaty | 139/435 |
| 3,543,808 | 12/1970 | Moessinger | 139/443 |

FOREIGN PATENT DOCUMENTS

| | | |
|---|---|---|
| 1272843 | 2/1960 | Fed. Rep. of Germany . |
| 2363658 | 3/1978 | France . |
| 2476154 | 8/1981 | France . |
| 2477587 | 9/1981 | France . |

OTHER PUBLICATIONS

L'Insertion de la Trame par Inertie, (Industrie Textile), 1978, No. 1083, pp. 698-699.

*Primary Examiner*—Henry S. Jaudon
*Attorney, Agent, or Firm*—Parkhurst & Oliff

[57] ABSTRACT

The invention relates to a process for the insertion of a weft yarn in the shed of a weaving machine in which said weft yarn is drawn from a reserve located outside the shed to be inserted in the form of a loop of which one of the ends is fastened and the other thrown, wherein an air stream is blown in the shed in the direction of insertion of the weft, the speed of this air stream being less than or at the most equal to the speed of the thrown end, the action of this air stream being such that it tends to maintain the two ends of the loop separate from each other.

6 Claims, 4 Drawing Figures

PROCESS FOR THE INSERTION IN THE FORM OF A LOOP OF A WEFT YARN IN THE SHED OF A WEAVING MACHINE AND WEAVING MACHINE EQUIPPED WITH A DEVICE FOR CARRYING OUT THIS PROCESS

The present invention relates to a process for the insertion of a weft yarn in the form of a loop in the shed of a weaving machine; it also relates to a weaving machine equipped with a device for carrying out this process.

The insertion of a weft yarn in the form of a loop in the shed of a weaving machine has been envisaged by technicians for a long time and is described in particular in U.S. Pats. Nos. 2,982,315 and 3,543,808. The former Patent proposes inserting the weft in the shed of a weaving machine in the form of a loop propelled by a jet of compressed air blown via a valve controlled in synchronism with the cycle of the machine, the two ends being pushed equally solely by this air stream. In the second Patent mentioned, the insertion of the weft yarn in the form of a loop is generally obtained by propelling it through the shed thanks to the energy that it possesses when it is thrown at an initial speed. According to this document, the yarn is projected in the form of a loop of which one end is fastened in a clip and the other end is thrown by a device capable of communicating an initial speed thereto, for example by means of intermittently acting rotating rollers or by means of a system acting in the manner of a whip.

The determination of the speed of the loop during its path through the shed as a function of the speed of throw is described in an article published in the journal "Industrie Textile - No. 1083-November 1978 - pages 698–699". This study shows a magnitude KNg in which K represents the coefficient of resistance to air, N the count of the yarn and g the acceleration of gravity, which constitutes a criterion of possibility of throwing a given yarn; the higher the value of KNg, the more the speed drops and the length of insertion is short. Consequently, this process presents the drawback of not being adapted to the work of the yarns for which the action of the force of traction following from the kinetic energy is insufficient with respect to the action of the aerodynamic resistance exerted thereon.

The process according to the invention aims at solving this problem.

Furthermore, it has also been observed in the case of throwing a weft yarn in the form of a loop, that, in certain cases, the free end of the yarn (the thrown end) could either float as a flag or, when it encountered an obstacle, for example when it came into contact with a warp yarn, hook on and even wing around this warp yarn under the effect of its speed and mass, which could provoke a sudden braking. Such a phenomenon of hooking has been observed in weaving looms in which the yarn, wound in a loop by a false shuttle, had one end free and one end floating in the second half of its insertion. This explains why these looms have not been developed industrially to a large extent. On the other hand, if the obstacle is a fairly wide smooth surface, even an interrupted surface such as a comb or a confiner, there will be no hooking on. The insertion method according to the invention is similar to unwinding a loop by a false shuttle; the hooking of the picks on the warp yarn is therefore foreseeable.

The process according to the invention also aims at solving this problem.

The invention therefore generally relates to an improvement to the process for the insertion of a weft yarn in the shed of a weaving machine and in which said weft yarn is drawn from a reserve located outside the shed to be inserted in the form of a loop of which one of the ends is fastened and the other thrown, which enables the above-mentioned problems to be solved, the improvement according to the invention being characterized in that the weft loop is subjected to the action of an air stream directed in the direction of insertion of the weft, said air stream exerting its action within the shed itself, at least over a major part of the length of said shed, this at a speed less than or at most equal to the speed of the thrown end, the action of this air stream being such that it tends to maintain the two ends of the loop separate from each other.

According to a preferred embodiment of the process, the speed of the air stream varies along the shed and is at its maximum close to the throwing member.

Such an air stream may be obtained either by means of a blowing nozzle disposed outside the shed, near its inlet but which delivers inside said shed an air stream having the above-mentioned characteristics, or by means of a plurality of nozzles spaced apart from each other, distributed along the shed inside said shed and which blow in a plane different from the plane passing through the two ends so that the combined action of this blowing and the lateral losses of the air passage separate the two ends and avoid their accidentally meeting.

The use of an air stream to throw a weft in the shed of a weaving loom is well known to technicians and is currently used at the present time on weaving looms without shuttle or with "air jet", as shown in particular in U.S. Pat. No. 3,139,118.

It has also been proposed, for example in German Patent No. 1 272 843, to use an additional air jet to facilitate insertion of a weft thrown in the form of a dart by rotating rollers. However, the teaching of these prior techniques does not lead to the solution forming the subject matter of the present invention, as they involve working with considerable air pressures in view of the fact that a yarn (which has no rigidity) is to be pushed into a shed which may be several metres long and that all resistance of the air acting on the tip and the advanced parts of the yarn must be eliminated, failing which the yarn forms into a clew and further increases its resistance. In such a case, experience has shown that a blowing pressure of more than one bar was necessary, whereas according to the invention, one tenth of a bar is enough.

The association of a pneumatic nozzle with a device for throwing a weft in the form of a loop has also been proposed by one of the present inventors in French Pat. No. 2 476 154. In this document, the function of the blowing nozzle is to stretch the loop at the moment of acceleration thereof, acceleration given by a throwing member incorporating rollers, this in order to avoid those parts of the yarn which always move more quickly encountering the preceding, less rapid parts. Consequently, this nozzle essentially acts when the loop is actually being formed and not, in accordance with the invention, inside the shed itself, so that the two ends of the loop are maintained separated from each other.

The present invention also relates to an improved weaving machine for carrying out the above-mentioned process.

This weaving machine is of the type comprising:

a reserve of weft yarn located ouside the shed, a metering device issuing a given length of yarn into, an accumulator, an inserting member drawing the yarn from the accumulator and throwing it in the form of a loop having one end fastened and one end thrown, means for pressing against the fell of cloth the weft yarn which has just been inserted, and it is characterized in that it further comprises pneumatic means producing an air stream inside the shed, during the insertion, of which air stream the speed is less than or at the most equal to the speed of the thrown end and which is exerted at least over a major part of the length of said shed, said air stream tending to maintain the two ends of the loop separate from each other.

According to a preferred embodiment of the invention:

the air stream is confined, in known manner, within the shed by a channel constituted by leaves spaced apart from one another to allow displacement of the warp yarns;

in one embodiment, the pneumatic means are constituted by a nozzle, disposed near the entrance of the shed, this nozzle presenting an outlet element having a section close to that of said channel, being traversed axially by a channel allowing the loop of yarn to pass, this channel advantageously being flat; according to another embodiment, the pneumatic means are constituted by a succession of auxiliary nozzles, distributed along the shed and inside said shed and which blow in a plane different from the plane passing through the two ends of the loop;

the machine comprises a channel constituted by spaced apart leaves, this channel preferably being mobile with the batten of the loom whereas the nozzle itself is fixed, and the outlet element of the nozzle being constituted by a piece independent of said nozzle, mounted on the batten, this piece intercepting the air stream when it is displaced in front of the nozzle.

The invention will be more readily understood on reading the following description with reference to the accompanying drawings, in which.

Figure 1:
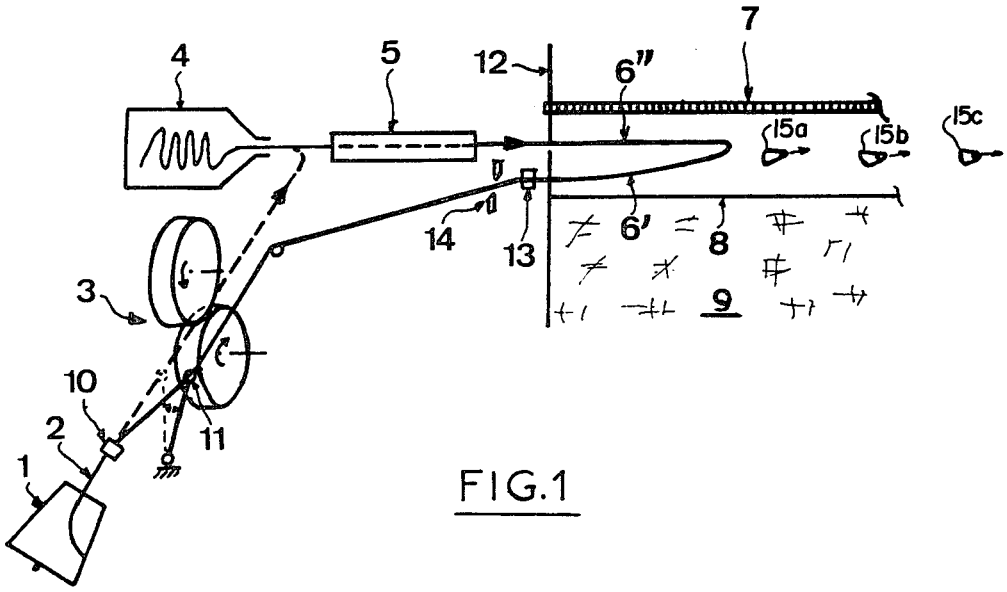
FIG. 1 is a schematic view of a weaving loom for carrying out the process according to the invention, in which the air stream acting inside the shed is obtained by means of auxiliary nozzles spaced apart from one another, disposed within the shed itself.

Referring now to the drawings, according to the embodiment illustrated in FIG. 1, the weaving loom according to the invention comprises, in known manner.

a reserve 1 (bobbin) of weft yarn 2 located outside the shed, a metering device 3 incorporating rollers which issues, at a determined rhythm, the yarn 2 (shown in broken lines) into an accumulator 4, an inserting member 5 which draws the yarn 1 from the accumulator 4 and throws it inside the shed, in the form of a loop having a fastened end 6' and a thrown end 6'', means (reed 7) for pressing the weft yarn against the fell 8 of the cloth 9 after insertion.

The operation of such a weaving machine is similar to that described in French Pat. No. 2 477 587 and will therefore not be described in detail, but may be summarized as follows.

The weft yarn 2 drawn from the reserve 1 passes over a brake 10, then in a mobile guiding eyelet 11 which introduces it (position in broken lines in FIG. 1) and withdraws it cyclically (position in solid lines in FIG. 1) from the metering device 3 incorporating rotating rollers. When the yarn is introduced into the metering device 3, it is guided inside the accumulator 4 (path in broken lines). When the desired length of yarn is metered, the guiding eyelet 11 moves (position shown in solid lines,) so as to bring the yarn 2 out of the metering device 3. The shed formed by the warp yarns 12 and the reed 7 is open and the yarn contained in the accumulator 4 is thrown, via a rotating throwing member 5 into said shed, forming a mobile end 6'', whilst the part of this yarn connected to the reserve 1 is blocked in the brake 10. The loop which forms is clamped in the clip 13 which forms the fixed point of the fastened end 6' of the loop and maintains this fastened end 6' in a determined position at a certain distance from the thrown end 6''. When the accumulator 4 is empty, cutters 14 cut the yarn of which the released part returns towards said accumulator 4.

According to the invention, in order to maintain the two ends 6' and 6'' of the loop separate from each other, as well as to facilitate the insertion of said loop inside the shed, auxiliary nozzles 15*a, b, c,* of known type, are distributed along the shed and blow in a plane different from the plane passing through the two ends 6' and 6''. This combined action of the air stream as well as the lateral losses of the air channel tends to separate the ends and avoids any accidental encounter likely to occur when all the thrown end 6'' has left the accumulator and has been completely thrown. The structure and operation of these additional nozzles 15*a, b, c* will not be described in detail, as the nozzles are of known type and their adaptation according to the invention to facilitate insertion of the weft in the form of a loop residing, on the one hand, in that they are supplied under low pressure, of the order of about the tenth of bar, in order to obtain a speed of the air stream inside the shed less than or at the most equal to the speed of the thrown end and, furthermore, their orientation is such they blow in a plane different from the plane passing through the two ends 6' and 6''.

Figure 2:
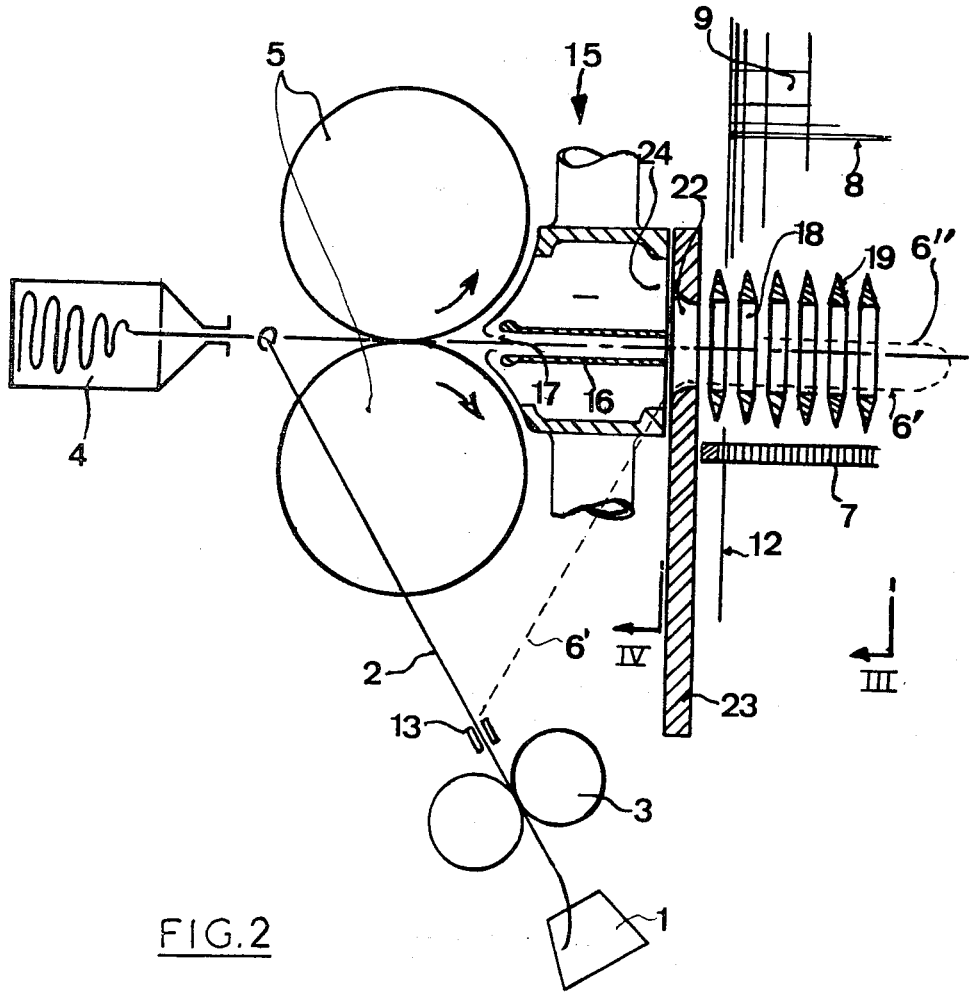
FIG. 2 illustrates another embodiment of the process according to the invention, in which the air stream is created by means of a nozzle disposed outside the shed and in the vicinity of said shed.
Figure 3:
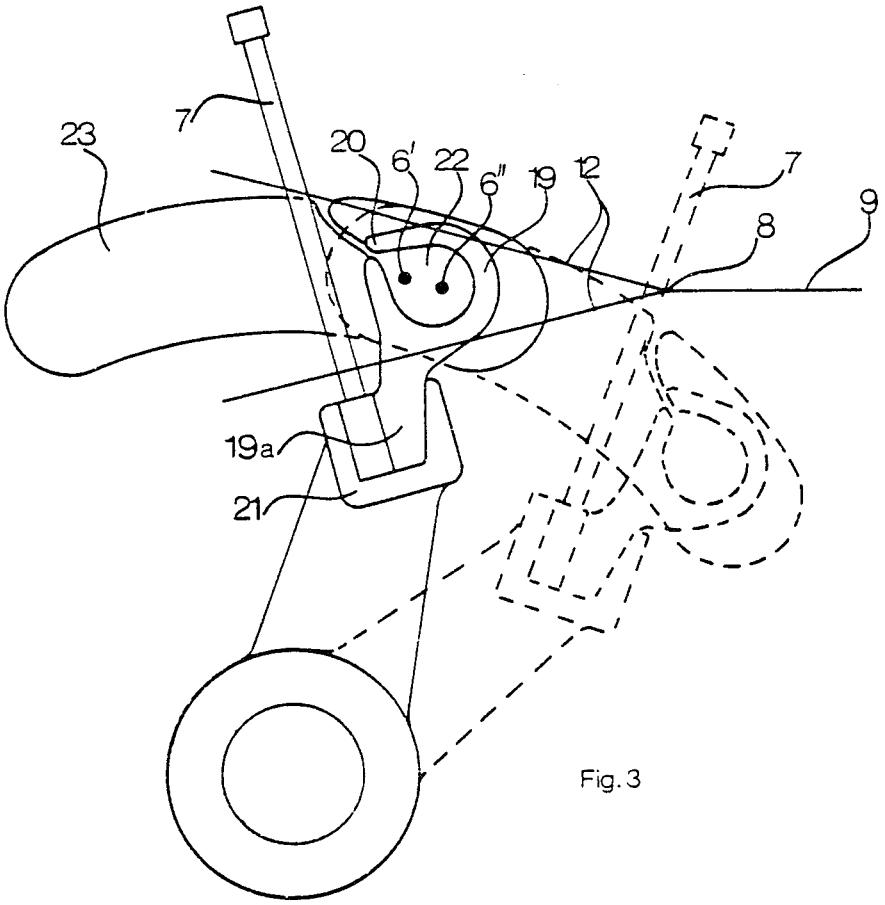
FIGS. 3 and 4 are views in detail of the weaving machine illustrated in FIG. 2, FIG. 3 being a section along axis III showing the manner in which the channel confining the air stream inside the shed is produced and FIG. 4 being a view along axis IV showing in greater detail the structure of the blowing nozzle.
Figure 4:
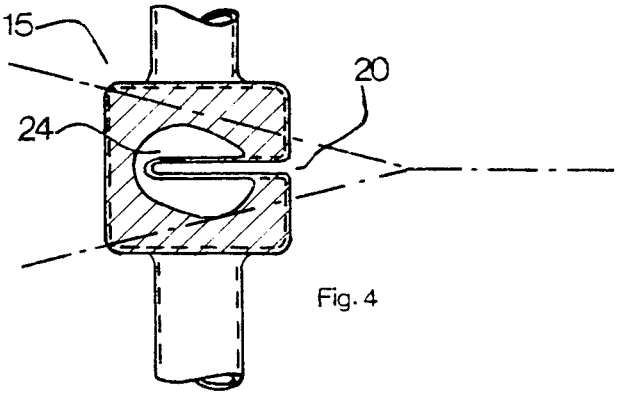

FIGS. 2, 3 and 4 illustrate a variant embodiment according to the invention in which the pneumatic means subjecting the loop formed to an air stream which acts inside the shed, with a speed less than or at the most equal to the speed of the thrown end, so as to separate the two ends of the loop from each other, are constituted by a single nozzle, designated by general reference 15, and disposed near the entrance of the shed. In this embodiment, the same elements or elements performing the same functions will be designated by the same references as in the preceding example.

Referring to FIGS. 2, 3 and 4, the weft yarn 2 whose end is fastened in a clip 13, is thrown in the form of a loop presenting a fastened end 6' and a thrown end 6'' by means of a system of rollers 5 rotating in the direction indicated by arrows. In this example, the plane in which the yarn 2 passes when it comes from the position shown in solid lines when it is guided in the accumulator 4 to the position shown in broken lines during throwing is substantially the median plane of contact of the two rollers 5.

According to the invention, a single nozzle 15 is disposed as close as possible to the outlet of the rollers 5, the inlet face of said nozzle presenting a concave outer section enabling it to follow the shape of the space between the two rollers 5. This nozzle 15 comprises an axial conduit 16, preferably flat, allowing passage of the loop of yarn. This channel 16 is open on the side in order to allow the fastened end 6' of the loop to pass and is disposed substantially in the plane of contact of the two rollers 5. Moreover, the nozzle 15 may be provided, in known manner, with air guides (not shown) distributing the air speed in the whole section in which it blows. The channel 16 of the nozzle may possibly present orifices 17, disposed in its inlet zone and which make it possible to increase the intensity of the air streams from the beginning of throw of the weft.

Furthermore, in this embodiment, in order to confine the air stream and to reduce the rate of flow of fluid, the nozzle 15 blows in a channel 18 disposed inside the shed and which presents a substantially smaller section than the shed.

In order to form the passage of the warp yarns 12, this channel 18 is constituted by a plurality of regularly spaced identical leaves 19, the assembly of which defines a substantially circular conduit. As shown in FIG. 3, a longitudinal opening 20 enables the weft yarn to emerge after insertion, the channel 18 then taking the position shown in broken lines.

The leaves 19 constituting the channel 18 are fixed for example via an extension 19*a* enabling them to be fixed directly to the batten 21 of the machine. It may possibly be envisaged to fix the leaves 19 on another oscillating shaft (not shown) than that of the batten 21 connected thereto through connecting rods and levers, which would enable the channel 18 to be given a movement different from that of the batten 21.

The batten 21 comprises a reed 7, in known manner. As is clearly visible in FIG. 2, the bore made in each leaf 19 so as to form the channel 18 has a known truncated shape, made such that an air stream enters through the large opening and leaves through the small, this with the purpose of better channeling the air.

It may be envisaged to mount the nozzle 15 so that it follows the movement of the channel 18. However, in a preferred embodiment, this nozzle 15 is disposed permanently, only the outlet 22 of the nozzle 15, made in a piece 23, being mounted fast with the channel 18, and thus following the displacement of said channel 18. In this way, the advantage of having an air stream which is perfectly positioned with respect to the yarn is maintained, whilst avoiding the difficulties in producing the displacement of the nozzle.

Moreover, the piece 23 in which the outlet element 22 is formed, by moving with channel 18, periodically obturates the nozzle 15, which avoids a marginal air blow with respect to channel 18. The opening 24 of the nozzle 15, located on the outlet element 22 side, is larger than the outlet 22 in order to maintain a maximum flow of air in this element, when the outlet 22 moves towards its rear return point. Finally, the shape of the outlet 22 is similar to that of the section of the channel 18 to obtain optimum yield of the air stream.

Operation of such a machine is similar to that described hereinbefore by the example illustrated by FIG. 1, and will therefore not be taken up again in detail. In this embodiment, as for the example described previously, the loop of yarn formed inside the shed is subjected to the action of an air stream coming from nozzle 15, this air stream acting on the loop with a speed lower than or at the most equal to the speed of the thrown end 6'' of said loop and tending to separate the thrown end 6'' from the fastened end 6'. Not only does this air stream maintain the ends separate from each other, but it also reduces the aerodynamic braking force undergone by the loop without intervening in the actual propulsion of the yarn. In this way, it is possible to reduce the relative speed of the yarn with respect to the air and consequently use yarns of any nature.

With respect to the prior known weaving machines throwing the weft yarn either in the form of a loop presenting a fastened end and a thrown end, or by employing the action of an air stream acting on the pick during insertion thereof, the process according to the invention presents numerous advantages which could not be deduced from the prior state of the art. In fact, it was totally unforeseeable that the simple action of an air stream under low pressure, acting under determined conditions (speed, action on the length of the shed, direction) during insertion of a weft thrown in the form of a loop unwinding inside the shed, would make it possible not only to maintain the advantages of such an insertion technique, but would also eliminate the drawbacks associated with this mode of insertion, namely the risk of the mobile end touching the fixed end or any other obstacle on its path (for example warp yarn), thus causing a risk of defect in the fabric. Such a process enables not only the speeds of production, but also the width of weave to be increased.

The invention is, of course, not limited to the embodiments described hereinabove, but covers all variants thereto made in the same spirit.

What is claimed is:

1. A weaving machine of the type comprising:

a reserve of weft yarn located outside the shed;

a metering device issuing a given length of yarn into an accumulator;

an inserting member drawing the yarn from the accumulator and throwing it in the form of a loop having one end fastened and one end thrown;

means for pressing against the fell of cloth the weft yarn which has just been inserted;

pneumatic means producing an air stream inside the shed, during the insertion, the speed of the air stream being at most equal to the speed of the thrown end and being exerted at least over a major part of the length of said shed, said air stream tending to maintain the two ends of the loop separate from each other;

wherein the air stream produced by the pneumatic means is confined inside the shed by a channel constituted by leaves spaced apart from one another to allow passage of the warp yarn therebetween;

and wherein the pneumatic means comprises a single nozzle disposed near the entrance of the shed, the outlet aperture of the nozzle presenting a section similar to that of the channel.

2. The weaving machine of claim 1, wherein the channel is mobile with the batten, an intermediate piece also being mounted on said batten and comprising a mobile outlet element for the nozzle.

3. The weaving machine of claim 2, wherein the outlet aperture of the nozzle is of larger section than that of the mobile nozzle outlet element.

4. The weaving machine of claim 2, wherein the intermediate piece intercepts the air stream when it is displaced in front of the nozzle.

5. The weaving machine of claim 1, wherein the nozzle is traversed axially by a flat channel allowing the loop of yarn to pass.

6. The weaving machine of claim 1, wherein the rear face of the nozzle is sectioned so that the inlet orifice of the channel is disposed as close as possible to the yarn throwing means.

* * * * *